US006931671B2

(12) United States Patent
Skiba

(10) Patent No.: US 6,931,671 B2
(45) Date of Patent: Aug. 23, 2005

(54) LIGHTWEIGHT IMPACT RESISTANT HELMET SYSTEM

(76) Inventor: Joseph Skiba, 49 Washington Ave., River Edge, NJ (US) 07661

( * ) Notice: Subject to any disclaimer, the term of this patent is extended or adjusted under 35 U.S.C. 154(b) by 0 days.

(21) Appl. No.: 10/625,715

(22) Filed: Jul. 22, 2003

(65) Prior Publication Data

US 2005/0015855 A1 Jan. 27, 2005

(51) Int. Cl.[7] ..... A63B 71/10
(52) U.S. Cl. ..... 2/425; 2/410; 2/411; 2/412
(58) Field of Search ..... 2/410, 411, 412, 2/414, 425, 421, 903

(56) References Cited

U.S. PATENT DOCUMENTS

| | | | | | |
|---|---|---|---|---|---|
| 2,423,076 | A | * | 7/1947 | Daly | 156/211 |
| 2,766,453 | A | * | 10/1956 | Frieder et al. | 156/148 |
| 3,353,187 | A | * | 11/1967 | Lastnik et al. | 2/412 |
| 4,307,471 | A | | 12/1981 | Lovell | 2/411 |
| 4,370,754 | A | | 2/1983 | Donzis | 2/2 |
| 4,453,271 | A | | 6/1984 | Donzis | 2/2 |
| 4,466,138 | A | | 8/1984 | Gessalin | 2/243 |
| 4,581,776 | A | | 4/1986 | Kie | 2/425 |
| 4,985,931 | A | | 1/1991 | Wingo, Jr. | 2/2 |
| 5,075,904 | A | * | 12/1991 | Shirasaki et al. | 2/412 |
| 5,105,473 | A | | 4/1992 | Valtakari | 2/2 |
| 5,112,667 | A | * | 5/1992 | Li et al. | 428/113 |
| 5,146,621 | A | | 9/1992 | Hadar et al. | 2/2 |
| 5,353,437 | A | | 10/1994 | Field et al. | 2/2 |
| 5,424,021 | A | * | 6/1995 | Nakade et al. | 264/257 |
| 5,465,424 | A | | 11/1995 | Cudney et al. | 2/2 |
| 5,493,736 | A | | 2/1996 | Allison | 2/416 |
| 5,561,866 | A | | 10/1996 | Ross | 2/410 |
| 5,729,830 | A | | 3/1998 | Luhtala | 2/2.5 |
| 5,790,988 | A | | 8/1998 | Guadagnino, Jr. et al. | 2/411 |
| 5,794,271 | A | | 8/1998 | Hastings | 2/412 |
| 5,857,215 | A | | 1/1999 | Fergason et al. | 2/8 |
| 5,862,528 | A | * | 1/1999 | Saijo et al. | 2/411 |
| 6,012,178 | A | | 1/2000 | Schuster et al. | 2/412 |
| 6,070,273 | A | | 6/2000 | Sgro | 2/455 |
| 6,131,207 | A | | 10/2000 | Basson et al. | 2/410 |
| 6,154,889 | A | | 12/2000 | Moore, III et al. | 2/418 |
| 6,298,483 | B1 | | 10/2001 | Schiebl et al. | 2/9 |
| 6,397,402 | B1 | | 6/2002 | Holland et al. | 2/467 |
| 6,434,755 | B1 | * | 8/2002 | Halstead et al. | 2/414 |
| 6,499,147 | B2 | | 12/2002 | Schiebl et al. | 2/425 |
| 2003/0139104 | A1 | * | 7/2003 | Arai | 442/35 |

FOREIGN PATENT DOCUMENTS

| | | | | | |
|---|---|---|---|---|---|
| JP | 06173110 | A | * | 6/1994 | A42B/3/06 |
| JP | 08311713 | A | * | 11/1996 | A42B/3/06 |
| JP | 09041213 | A | * | 2/1997 | A42B/3/06 |
| WO | WO 9400031 | A1 | * | 1/1994 | A42B/3/06 |

* cited by examiner

*Primary Examiner*—Rodney M. Lindsey
(74) *Attorney, Agent, or Firm*—Ernest D. Buff & Associates, LLC; Ernest D. Buff; Dave Narasimhan

(57) ABSTRACT

A strong, lightweight, impact resistant helmet system protects the wearer from impact injury and minimizes bodily injury to other players brought into contact therewith during blocking and tackling events. Weight reduction is achieved by reinforcing inner and outer surfaces of the helmet shell with long length, high strength fibers. Orientation of the fibers is such that the fiber lengths are aligned generally in the direction of tension and compression forces imposed on the helmet surface during impact. This reinforcement geometry permits use of a thin helmet shell. Efficient impact absorption by the helmet shell is accomplished by limiting the bend curvature produced at the impact location. The bend curvature reduction increases the contact area between the helmet shell and a second pliable padded inner helmet made from energy absorbing polymeric foam disposed within the helmet shell in contact with its inner surface. The second pliable padded inner helmet rests on the wearer's head, held in place by an attachment mechanism associated with the helmet shell. Energy is absorbed when the inner surface of the helmet shell contacts and compresses the inner helmet. The reduced bend curvature of the helmet shell spreads impact forces over a large area, and the impact load experienced by the wearer is decreased.

9 Claims, 1 Drawing Sheet

LIGHTWEIGHT IMPACT RESISTANT HELMET SYSTEM

BACKGROUND OF THE INVENTION

1. Field of the Invention

The present invention relates to helmets for participants of contact sports; and more particularly to a strong, lightweight helmet system that provides increased protection to the wearer, and decreases forces applied against other players during contact events.

2. Description of the Prior Art

Many approaches have been disclosed for constructing football and other sports activity helmets that provide protection to players engaged in contact sports. These approaches focus on protecting the helmet wearer. They provide little or no protection to other players during blocking and tackling events.

U.S. Pat. No. 4,307,471 to Lovell discloses a protective helmet. The protective helmet has two shells, an inner shell and an outer shell, which slide with respect to each other. Such sliding action absorbs energy of impact. The inner and outer shells are slidably connected to each other in at least two locations juxtaposed to the edge of the outer section. The outer section is spaced apart from the inner section away from these locations, with the outer section being adapted to move relative to the inner section on impact of an object with the outer shell. A plurality of projections function at the above-described locations between the inner shell and the outer shell. These projections may be integral with either the inner or the outer shell so as to create a sliding action between the projections when impact occurs. The patent discloses a protective helmet with two shells fabricated from a variety of thermoplastic and thermoset polymers. Preferably the polymer is selected so that injection molding techniques may be used in the manufacture of the helmet. Each of the inner and outer shells can slide with respect to the other when the helmet is impacted, providing shock absorption. The sliding mechanism disclosed by the '471 patent fails when the projections are worn out, limiting the helmet's service life. When these projections are worn out, the user is unaware of the decreased impact protection afforded by the helmet. The two-shell helmet construction is heavy. In addition, the helmet is difficult to wear owing to the relative displacement of the two shells, which oftentimes fail to return to their original position after a minor impacts, causing alterations of the helmet weight distribution.

U.S. Pat. Nos. 4,370,754 and 4,453,271 to Donzis disclose a protective garment having a variable pressure pad. The protective garment is primarily intended for use with athletic equipment. It includes protective gear for the shoulders, ribs, biceps, forearms, thighs, knees and shins. This protective garment is composed of variable pressure pads, air cushions, and/or shields. Each of the variable pressure pads includes two superimposed plies of a lightweight, non-elastic fluid-impervious fabric material. Adjacent surfaces of the fabric material are sealed around the periphery to form a pressure tight inflatable garment, which does not distend. The internal fluid chambers are fluidly communicable with adjacent fluid chambers by means of the fluid passageways. The material crinkles and folds over at pre-selected regions to constrict fluid communication between the fluid chambers as an external force is applied to the variable pressure pads. Air cushions, in the form of a plurality of tubular air chambers, are mounted on the variable pressure pads at certain critical locations to provide additional cushioning and dispersion of an external force over an area wider than the impact area. Shields are mounted over the variable pressure pads and/or air cushions to provide additional means for apportioning the external force. Vent holes are provided in the variable pressure pads and shields to permit the garment to breathe by permitting air to pass from the surface of the body through the pads, creating a chimney effect beneath the variable pressure pads. The preferred material for the manufacture of the variable pressure pad is a woven fabric of a suitably strong, non-elastic fiber, such as nylon, polyester, or aramid, made fluid-impervious by coating it on at least one side with a natural or synthetic elastomeric material, such as rubber, polyisoprene, or polyurethane. The Donzis patents disclosure a variable pressure pad, which is incorporated in different portions of a body protection garment. The variable pressure pad is used as a shock-absorbing member within the shell of a football helmet. Such a variable pressure pad is not a football helmet; it does not protect the wearer from injury, or protect other opposing players that are contacted by the helmet.

U.S. Pat. No. 4,466,138 to Gessalin discloses a safety helmet for a vehicle rider. The helmet comprises a shell injected with a thermoplastic material. Also disclosed is a method for manufacture of the helmet. The helmet shell has a composite structure. It includes a rigid insert composed of a reinforced resin, and an outer casing composed of injected thermoplastic material. The outer casing is molded onto the insert, which is embedded within the mass of the outer casing. After cooling, the helmet shell is pre-stressed by shoulders on overlapping portions of the casing. The helmet disclosed by the patent is especially suited for vehicle riders. It comprises a rigid helmet having a reinforced inner insert captured in an injection molded outer shell. The outer shell carries provisions for pre-stressing the inner shell and provides attachment points for a chin guard, visor or the like. The helmet disclosed by patent is not a football helmet; it provides visibility within a very narrow region. Owing to the attachment of a visor chin guard and accessories, no protection is provided within the player's face region. The helmet disclosed by the '138 patent does not prevent bodily injury to other football players that are contacted by the helmet.

U.S. Pat. No. 4,581,776 to Kie discloses a motorcycle helmet. The motorcycle helmet has a sliding visor that moves on tracks on opposite sides of the eye area of a wearer's face. The visor slides relative to a casing which envelopes the back, side and crown of a wearer's head to selectively expose and shield the wearer's eyes. A chin guard is hinged to one side of the casing and a latch mechanism with a release actuator is located on the opposite side. An inflatable bladder, located within the chin guard, serves as a cushion and can be inflated by the user once the jaw guard is latched. Operation of the release actuator to unlatch the jaw guard causes the bladder to deflate. The motorcycle helmet disclosed by the '776 patent has a visor in front and a bladder chin rest to maintain the helmet in place. It is not a football helmet, and does not provide the visibility needed for a football player. No protection is provided to other football players that are contacted by the helmet during blocking or tackling events.

U.S. Pat. No. 4,985,931 to Wingo discloses a shock absorbing pad structure for athletic equipment. The shock absorbing pad structure for athletic equipment, such as shoulder pads, has a foam member, having an undulated configuration formed by a plurality of elevations and depressions, arranged in a staggered relationship with respect to one another, disposed within a flexible, substantially air impermeable enclosure. The flexible enclosure has at least one air permeable portion disposed therein. A plurality of pads containing foam elements selectively release air through a passageway to provide shock absorption. The shock absorbing pad structure disclosed by the '931 patent is not a football helmet; it's protection is restricted to the shoulders, chest and other portions on the torso of a football player. No protection is provided for the head of a football player. Opposing players receive no protection from bodily injury when contacted by the helmet during blocking and tackling events.

U.S. Pat. No. 5,105,473 to Valtakari discloses a sports outfit having elastic fabric pockets for insertable resilient padding. An athletic garment for use in different sports includes trousers and/or a coat wherein outer pad pockets are attached. The pad pockets include hook and loop type closure tapes and are made of an elastic material, so that pads for the protection of the wearer can be inserted into and withdrawn from the respective pad pockets. Garment pockets into which these pads are inserted absorbing impact shock. The sports outfit disclosed by the '473 patent is not a football helmet; it is not operative to protect a football player's head from injury during game play. No protection is provided to opposing players that are contacted by the helmet during blocking or tackling events.

U.S. Pat. No. 5,146,621 to Hadar discloses a shoulder pad. The shoulder pad has a left-hand member that fits over the left shoulder and a right-hand member that fits over the right shoulder. Each of the members has an inverted U-shape as viewed from the side. In addition, each member has a chest plate portion, a back plate portion and an arch connecting the plate portions. The arches are laterally spaced to provide an opening for the neck of the wearer. Each of the members is fabricated from lightweight synthetic resin sheet material having a corrugated central layer formed with parallel corrugations, and a pair of generally parallel outer layers forming opposite exterior surfaces of the sheet material. The corrugations are resiliently deformable upon application of an impact load to the sheet material to attenuate the shock of the impact load on the wearer. Shoulder pads containing parallel elements with a corrugated interior absorb impact shock. The pad is comprised of several sections, which protect the left shoulder, left back, right shoulder and right back. No disclosure is contained by the '621 patent concerning a football helmet; the pad operates strictly to protect the shoulder, chest and back portions of a football or hockey player. The '621 patent does not disclose a device that protects the head of a football player during game play. No protection is provided to opposing players that are contacted by the device during blocking or tackling events.

U.S. Pat. No. 5,353,437 to Field discloses a combination helmet and body protection device for use in football and other hazardous activities such as driving, cycling, hockey, riot control, and fire fighting. The device is operative during these activities to protect against potentially crippling forces applied to the head and upper body. An upper torso section with internal padding cooperates with an outer helmet, which can be securely connected to the upper torso section. The construction of the device is such that the outer helmet cannot rotate with respect the torso section; but can be readily removed for easy installation. An inner helmet section fits securely on the wearer's head. The inner helmet section allows rotation of the wearer's head inside the outer helmet section. Such a helmet construction is similar to those conventionally used in American football events, with some significant exceptions. First, the face opening is much larger than conventional helmets to give the wearer a wider range of peripheral vision. Second, the face-mask extends up higher, thereby providing full protection to the head and face. The face-mask is secured by means of strong, flexible straps, which can be cut to remove the face-mask in an emergency. Third, the helmet incorporates a separate inner helmet section, which fits securely on the wearer's head and includes pads or bladders that absorb shock from direct blows to the head. The inner helmet is placed within the outer helmet and can rotate freely when the player turns his head, while the outer helmet remains fixed in position, rigidly attached to the upper torso section. The '437 patent discloses use of an outer helmet that is rigidly attached to the upper torso unit and has a larger than average front opening. Within this outer helmet there is an inner padded helmet, which is directly attached to the player's head. The gap between the outer and inner helmets enables free rotation of the inner helmet when a player turns his head. A larger opening in the outer helmet enhances visibility. During direct impact, the inner helmet can absorb some of the shock. However, the direct connection between the inner helmet and the upper torso, and the gap extant between the outer and the inner helmets, prevents the outer helmet from compressing the inner helmet to absorb shock. Moreover, the rigid attachment of the outer helmet to the upper torso section converts this helmet-body protection device into a formidable weapon, which would likely injure other players that contact it during blocking or tackling events.

U.S. Pat. No. 5,465,424 to Cudney discloses a body protector having an articulated shock-absorbing vest for use in equestrian sports. The vest is characterized by its capability to absorb traumatic impact and crushing forces, while not interfering with the movement of the equestrian rider's torso and arms. A back panel and two adjoining side panels are conformed to fit the human torso. Each panel includes a plurality of shock absorbing cellular foam ribs independently and movably supported in skeletal array. A protective spinal sheath is supported upon the back panel. This equestrian vest protects a horseback rider from injury to the chest and back portions. It is not a football helmet; and is not operative to protect a player's head and other critical body parts, such as the nose, eyes and ears, from injury during game play.

U.S. Pat. No. 5,493,736 to Allison discloses a sports helmet protective device. A modified football helmet has an inner cap attached by elastic straps to the inside of the helmet shell, providing a space above the cap. The helmet is further modified to incorporate a rigid collar that extends outwardly from the bottom of the helmet. A lower surface of the collar is positioned above two upright post members, which extend upwardly from a pair of rigid shoulder pads. The sports helmet protective device disclosed by the '736 patent uses a larger and deeper padded helmet designed so that the user's head contacts the helmet sides solely. With this arrangement, there is established a gap of 3 inches between the top of the user's head and the inner shell of the helmet. During use of the helmet, the player also wears a cap made from shock absorbing material. As such, the contact between the top of the helmet and the top portion of wearer's head is not established, even during severe blows to the helmet. In such circumstances, a collar on the helmet contacts two rigid posts attached to the shoulder pad, thereby maintaining the 3 inch gap during severe blows caused by blocking and tackling events. The helmet disclosed by the '736 patent is held in place solely by friction between the helmet and the portions of the cap adjacent to the sides of the user's head. Raming of the helmet establishes contact between the helmet collar and the post members. Significant forces are thereby created, which will likely injure opposing players.

U.S. Pat. No. 5,561,866 to Ross discloses a safety helmet for motorcyclists. An outer shell of the helmet is formed as a sandwich, with outer and inner composite layers made from impact-resistant resinous material. Each of the composite layers are separated from the other by an intermediate layer of resilient material. The impact-resistant material is preferably a cloth of high tensile strength fiber such as KEVLAR™, DYNEMA™, glass fiber, or carbon fiber. Cork, foamed or other resilient plastic can be used to form the resilient material. Preferably, the resilient material is a honeycomb material composed of paper or aluminum. The helmet is made by sequentially laying up, in or over a former, a first composite layer of resin and sheets of impact-resistant material, an intermediate layer of honeycomb material, and a second composite layer of resin and sheets of impact-resistant material. The outer shell has a polyhedral form comprising a plurality of polygonal faces with abutting edges. Presence of high strength outer and inner layers sandwiched with a resilient layer allows movement of the outer and inner layers; but this process does not absorb impact shock. The thin outer layer may crack under impact load. No disclosure is contained by the '866 patent concerning a football helmet. In addition, the helmet taught by the '866 patent would not be operative to protect against injury to players brought in contact therewith during blocking or tackling events.

U.S. Pat. No. 5,729,830 to Luhtala discloses a headgear that provides protection against ballistic projectiles. The headgear is adapted for use where a helmet is inappropriate or where the headgear is designed not to differ in appearance from conventional headgear. Protection structures of the headgear are composed of flexible protective and damping layers in the headgear's outer and inner surface materials. These protection structures are, optionally, removable with a visor. Such protection headgear resembles a hat, but provides protection. It comprises three main parts. A mantle part having the form of a cylinder or truncated cone surrounds the wearer's head. The mantle part has a top part at the highest point, and a visor. A band surrounds the upper part of the mantle part, from the top part's outer edge downwards. The band is fixed to the protection headgear only along its upper edge. The protection headgear may also have protective and damping layers. These damping layers are arranged directly in a pocket member. The '830 patent disclosure describes a protection headgear that does not look like a helmet; but more closely resembles a hat with a visor. The top portion, rim portion and visor portion are protected with a band, protective and damping layers. No disclosure is contained by the '830 patent concerning a football helmet, and the protection headgear described therein is impractical for use during game play. Moreover, the headgear disclosed by the '830 patent is not firmly attached to the user's head. It would protect neither the wearer nor other players brought into contact therewith during blocking or tackling events.

U.S. Pat. No. 5,790,988 to Guadagnino discloses a protective headgear. A lightweight protective headgear for athletes and persons involved in activities involving a high falling risk. The protective headgear of this invention comprises a one-piece body of form-molded soft resilient closed cell foam material covered with a tough pliable surface coating. Such headgear has a double securing feature. Securing of the headgear is effected under the chin of the user and at the back of the head so that, when adjusted in position, the headgear will stay fixed throughout usage. The protective headgear also provides adequate ventilation through spaces in the tip portion. The '988 patent discloses a low duty, protective headgear for youths not involved in high-risk sports. Such headgear comprises a closed cell foam resilient material covered with a pliable smooth coating. The protective headgear disclosed by the '988 patent does not constitute a football helmet. It would provide little or no protection to the wearer or to other players brought into contact therewith during blocking or tackling events.

U.S. Pat. No. 5,794,271 to Hastings discloses a helmet shell structure utilizing a first inner layer of epoxy resin shaped into a head covering of a desired size and configuration. A second layer of woven fabric is placed atop the first layer of epoxy. A third outer layer of epoxy resin is laid atop the second layer and is cured to a transparent state such that the second layer of woven fabric is visible through the third outer layer of cured epoxy. The disclosure details helmet shell structure for crash helmets. Such crash helmets are formed by a first epoxy layer, a second layer of woven fabric followed by a third layer of transparent epoxy. Plugs composed of epoxy are used to maintain integrity of the three layers. Critical areas of the helmet, such as flanges, receive a fourth layer of fiberglass adjacent to the first layer. Crash helmets disclosed by the '271 patent are not a football helmets; and cannot be worn on a football field due to their reduced visibility and lack of chin protection. They would provide little or no protection to the wearer or to other players brought into contact therewith during blocking or tackling events.

U.S. Pat. No. 5,857,215 to Fergason discloses a helmet wherein molded composite materials provide high performance head and face protection. A welding helmet having high structural integrity is formed using a single sheet of composite material, such as Kevlar fabric impregnated with a phenolic thermoset resin. A viewing port in the front of the helmet includes a welding lens of the fixed or automatically darkening type. Curves, bends, folds and steps in the composite material and trim pieces in the viewing port area and about the peripheral rim of the helmet shell provide additional stiffening for the helmet. The welding helmet is formed from a single sheet of composite material. The composite material preformed to a shape similar to that of the finished molded helmet shape, placed in a compression mold, and molded. During molding, the material is by applying heat thereto. A welding lens is then mounted within a viewing port of the welding helmet. The helmet is pivoted so that it can be swung to cover the welding work and protect the welder. Welding helmets of the type disclosed by the '215 patent are football helmets; and would not be suitable for use during football game play. In addition, the helmet taught by the '215 patent would not be operative to protect against injury to players brought in contact therewith during blocking or tackling events.

U.S. Pat. No. 6,012,178 to Schuster discloses an antiballistic protective helmet containing protective textile fabric layers made from antiballistic fibers. Such antiballistic fibers include aramide fibers, polyethylene fibers spun by the gel spinning process, glass fibers, metal fibers, or blends thereof. Aramide fibers are preferred. The textile fabric layers arranged on the side away from the wearer are made of multi-axial knitted fabric. Textile fabric layers located on the side toward the wearer are made of woven fabric. The layers of multi-axial knitted fabric preferably comprise 60–80% of all reinforcement layers. The '178 patent discloses an antiballistic helmet that incorporates multiple layers of multi-axial knitted fabric with fiber. Such fiber is tightly knit and oriented in several directions to prevent small fragments from penetrating the helmet, in a manner similar to a bullet-proof vest. Such a helmet is not designed or configured to absorb impact shock and is not a football helmet. It would provide little or no protection to the wearer or to other players brought into contact therewith during blocking or tackling events.

U.S. Pat. No. 6,070,273 to Sgro discloses body pads particularly suited for sports. These body pads protect the torso of the body. They are made from molded polypropylene foam contoured in a shape to conform to the body part being protected. Such body pads use a laminate reinforcement of scrim filaments bonded with the exterior of the molded body pad. The inner and outer covering panels for each body pad are formed from a laminate of synthetic material, which is woven and bonded to the body pad with the edges sealed. The patent discloses a padded garment made from polypropylene foam shaped to a body part appointed for protection. The shaped foam is covered with a synthetic fiber cloth. Clearly, the padded garment disclosed by the '273 patent would not be suitable for use in a football helmet. It would provide little or no protection to the wearer or to other players brought into contact therewith during blocking or tackling events.

U.S. Pat. No. 6,131,207 to Basson discloses a helmet having a resilient bending means in the lower rear portion of the helmet shell. Such a protective helmet has a main outer shell and a wall with a front facial opening. The lower rear portion of the spherical wall is provided with resilient bending means, which enable an accurate adjustment and a wearing comfort for the helmet in the zone of the user's nape. The '207 patent discloses a helmet adapted for use by aircraft pilots. Resilient elements of the helmet allow adjustment of the helmet's position based on the pilot's nape to locate the helmet correctly on the pilot's head. The helmet has a shell fabricated from a thermoplastic or thermosetting polymer matrix with high strength fibers, and comprises an inner padding. The fibers are randomly distributed in the matrix. They may be short length fibers and do not create a shock absorbing structure when the inner padding is compressed. The aircraft pilot helmet disclosed by the '207 patent would not be suitable for use as a football helmet. It would provide little or no protection to the wearer or to other players brought into contact therewith during blocking or tackling events.

U.S. Pat. No. 6,154,889 to Moore discloses a protective helmet for skiing, snowboarding, bicycling, rollerblading, skateboarding, rock climbing and the like. The protective helmet comprises a resilient shell having a plurality of slits. Each slit has a first end located at a lower edge of the shell and an adjustable width effective for adjusting the size of the shell. The helmet also has an energy absorbing liner disposed inside the shell. Such a shell is very stiff, to effectively distribute an impact force. The '889 patent discloses a protective headgear for use by cyclists and other recreational sports. Protective headgear of that type would not be suitable for use as a football helmet. Both the helmet shell and the foam lining are serrated, so that the size of the helmet can be reduced by tightening the belt. The helmet is molded with a thermoplastic or thermosetting resins having predominantly glass fibers to produce a stiff helmet. Since fibers are high in volume and are distributed randomly during the compression molding process, a shock absorbing structure is not created. Consequently, the protective helmet disclosed by the '889 patent would provide little or no protection to the wearer or to other players brought into contact therewith during blocking or tackling events.

U.S. Pat. Nos. 6,298,483 and 6,499,147 to Schiebl discloses a protective headgear and chin pad, together with a rigid shell and face pads which may be released and removed while the headgear is still on a person's head. A protective chin guard may be attached to the headgear by way of the face pads. The chin guard comprises a substantially rigid shell with a removable insert made of a flexible bladder filled with a shock absorbing fluid. The headgear comprises a shell made of an inner and outer material layered over an internal foam core to affect the helmet's strength and weight. Insertion of foam in between two stiff polymeric members does not provide a rigid structure. With that construction the impact load would be sustained solely by the outermost polymeric layer; the foam would collapse, thereby providing essentially no support. The helmets disclosed by the '483 and '147 patents are not a shock-absorbing helmets. They would provide little or no protection to the wearer or to other players brought into contact therewith during blocking or tackling events.

U.S. Pat. No. 6,397,402 to Holland discloses a protective uniform for combination football and skating game and other high-impact applications A protective uniform for a high-risk or high-impact activity or sport has a rear rigid shell, an artificial spine which may articulate at two sections attached to the shell, and a damper mechanism between the shell and artificial spine. In addition, the artificial spine may be attached to conventional or modified back and hip pads and/or a harness such as that worn by rappellers or skydivers. The shell preferably extends from the wearer's head to the tailbone and across the back. The top portion of the shell, together with side shields and a face shield, form a protective enclosure for the head, inside of which a conventional helmet may be worn. Preferably, the side shields are movably connected to the rigid shell and are also connected to conventional or modified shoulder pads. The artificial spine is preferably formed in three sections, each section being connected to the other by a limited range universal joint to provide a range of motion comparable to the human neck and back. Alternatively, the upper section may be fixed to the middle section and the lower section may have a swivel or universal connection to the middle section. The device disclosed by the '402 patent has an external support structure, which is attached to the body, and a helmet to transfer the impact load from the helmet to other strong portions of the body. It uses a pad construction that lamps the helmet. A universal joint hinged artificial spine transfers the load, and has a dampening piston and cylinder components. The helmet disclosed by the '402 patent is not a football helmet; it is not designed to absorb impact shock. Rather it clamps on to any helmet, transferring impact loads to strong lower portions of the body. By its very design the helmet disclosed by the patent also limits the mobility of the players. Oftentimes, as is the case with the helmet taught by the '402 patent, the very structures that impart shock absorption also prevent free movement of the football player. Consequently, the helmet disclosed by the '402 patent limits mobility of the wearer and provides no protection other players brought into contact therewith during blocking or tackling events.

There remains a need in the art for a helmet for football players and other athletes that is lightweight and strong, easy to wear and effectively absorbs impact shock to protect the wear and other players brought into contact therewith during game play. In addition, there exists a need for a helmet that is readily assembled at low cost, highly reliable in operation and enjoys extended service life under without developing cracks or indentations during contact events.

SUMMARY OF THE INVENTION

The present invention provides a strong, lightweight impact resistant helmet system that is inexpensive to construct and minimizes bodily injury to the wearer and other players during contact events of the type regularly occurring during professional football games. Generally stated, the helmet system comprises a polymeric helmet shell reinforced by a net or mesh of long length fibers that are permanently bonded to the inner and outer surfaces of the helmet shell during its manufacture. The reinforcing net or mesh of fibers prevents excessive bending of the helmet shell when impact load is applied thereto. A second pliable padded inner helmet made from shock absorbing material such as polymeric foam is attached permanently to the inner surface of the helmet shell. The second pliable padded inner helmet is typically 0.5 inch to 1 inch thick. During use of the helmet system, the second pliable padded inner helmet is in direct contact with the wearer's head, being held in place by straps or other attachment means provided in the helmet shell. When an impact load is applied against the helmet system, the helmet shell deforms with a low curvature. This causes a larger area of the second pliable padded inner helmet to support the impact load; and absorb it efficiently. In addition, the increased contact area redistributes the impact load. A much lower impact load intensity level is thereby produced at the wearer's head, providing for safer, more comfortable impact handling. The decreased weight and shock absorbing construction of the impact resistant football helmet improves player mobility and alleviates chances for bodily damage to other players brought into contact therewith by blocking and tackling events.

Typically the helmet shell is 1/16 inch to 1/4 inch thicic. It is composed of a polymeric material such as polycarbonate. A net or mesh of reinforcement fibers comprised of KEVLAR® or SPECTRA® in a polymeric matrix are bonded to the helmet shell at its inner and outer surfaces. KEVLAR is a registered trademark of DuPont and SPECTRA is a registered trademark of Honeywell International. As is known in the art. KEVLAR fibers are comnosed of a para-aramid, while SPECTRA fibers are comtposed of high density, extended chain, high modulus polyethylene. The fibers have a length typically greater than 1 inch. Long reinforcement fibers may be woven into a net or mesh while shorter fibers may be assembled to fonn a non-woven mesh. The mesh may be permanently bonded to the inner and outer surface of the shell during the injection molding step by lining the cavity appropriately with the net or mesh, or by layering the net or mesh with appropriate polymer mixture over a pre-molded helmet shell.

The football helmet system of the invention is inexpensive to manufacture and construct and easy to repair. It is exceedingly lightweight and comfortable to wear, thereby increasing mobility of players during football, baseball, hockey, cricket and lacrosse games. It absorbs impact loads effectively due to a unique construction wherein the helmet shell bends at a low curvature. This low-curvature bending action increases the contact area between the helmet shell and the second pliable padded inner helmet. Support contribution from the second pliable inner helmet shell, and contact load absorption, increases, and the intensity of the impact load at the wearer's head is markedly decreased. The helmet system is readily attached by straps or other attachment means provided in the helmet shell so that the second pliable padded inner helmet directly contacts the player's head. During use, the lightweight helmet system is safe, comfortable to wear increases player mobility and protects the wearer and other players brought into contact therewith during blocking or tackling events.

BRIEF DESCRIPTION OF DRAWINGS

The invention will be more fully understood and further advantages will become apparent when reference is had to the following detailed description and the accompanying drawings, in which.

DESCRIPTION OF THE PREFERRED EMBODIMENTS

Figure 1A:
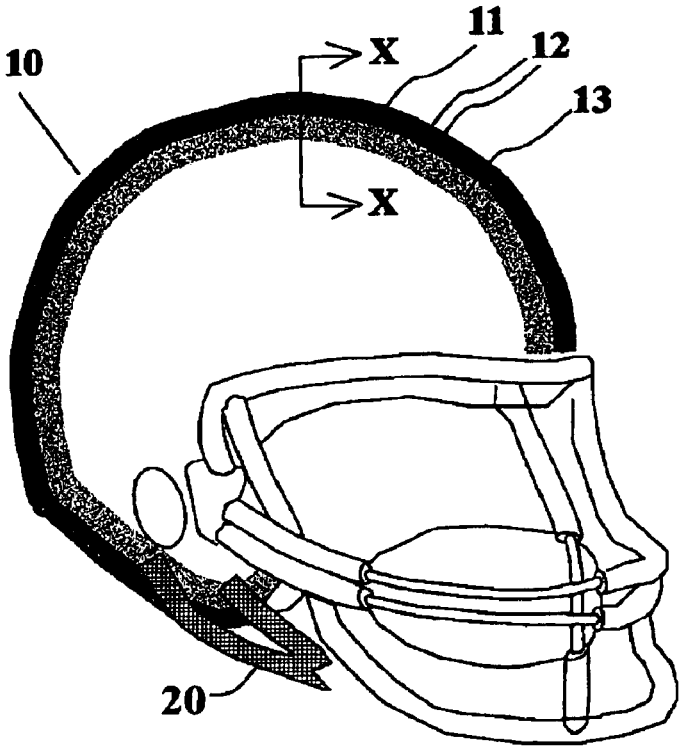
FIG. 1*a* is a schematic arrangement of the light weight impact resistant helmet system of the present invention.

One of the major disadvantages of currently used football helmets is that they are heavy, bulky and cumbersome to wear. These helmets protect the football player due to the stiff structure of the helmet shell, which carries energy absorbing absorbent pads. Due to their heavy weight, they readily produce bodily injury to other players brought into contact therewith during blocking and tackling events. A significant factor reducing this injury potential involves the overall weight reduction achieved by the helmet system without compromise to its impact absorbing characteristics.

The invention is directed to a high strength, crack-proof, chemically stable helmet system especially suited for contact sports, such as football, baseball, hockey, cricket and the like. Unlike conventional helmet shells, which are composed of molded polycarbonate plastics (typically Lexan®), the helmet system of the present invention is composed of Kevlar® or Spectra® in a polymeric matrix with long fibers oriented appropriately on the inner and outer surfaces of the polymeric helmet shell to resist impact stresses. The polymeric helmet shell may be manufactured from a number of polymers of thermoplastic or thermosetting variety. They may include poly-alpha-olefins (for example, polypropylene), homopolymers of ethylene and copolymers of ethylene and other alpha-olefins (for example, butene-1 and vinyl acetate), polyamides (for example polyhexamethylene adipamide), polycarbonate, polyvinyl chloride, cellulose acetobutyrate, polybutylene terephthalate, polyoxymethylene polymers polyester or epoxy. Polymers suitable for use in the helmet shell must withstand shear forces at the neutral axis of the helmet shell, which is its thickness center line, when impact load is applied. The fibers should have a length greater than 1 inch, and preferably greater than 2 inches. More preferably, the fibers are present in the form of a woven long length fiber net or mesh. Shorter fibers having length greater than 1 inch may be assembled to form a non-woven net. These fibers are located on the outer and inner surfaces of the helmet shell. They form a mesh or net supporting compressive and tensile stresses caused by impact against the helmet shell. In the event of impact, the inner surface is stressed in tension and the outer surface is stressed in compression, whereupon the embedded long length fibers in the helmet shell resist these forces, reducing the degree of bending deformation at the impact site. Such materials enhance impact resistance of the lightweight impact resistant football helmet to flexure and cracking. They infuse the helmet with higher overall strength, creating a reduced curvature-bending region where an impact load is applied.

A second inner pliable padded helmet made from shock absorbing material including polymeric foam is disposed in the helmet shell so as to be in contact with both the user's head and the helmet shell. The reduced curvature of the helmet shell allows a larger area of contact between the second inner pliable padded helmet and the helmet shell, thereby distributing an impact load to provide increased shock absorption area. The second inner pliable helmet additionally decreases forces encountered by other players brought into contact with the helmet during blocking or tackling events. Such lower forces result in part from the reduced force—deformation characteristic of the pliable material from which the second inner pliable helmet is formed. Injuries suffered by opposing players during game play are significantly reduced. The lightweight helmet enhances player maneuverability, thereby avoiding injuries produced by inadvertent collisions.

Fibers embedded on the outer and inner surfaces of the helmet shell provide superior resistance to breakdown by chemicals used to clean and disinfect the helmet. The in-service life and reliability of the helmet is thereby improved. Helmet systems constructed in accordance with the invention are strong, light, impact resistant, safe to use, operate reliably over an extended period of time, thereby providing increased protection to players of impact sports.

The helmet shell and the second inner pliable padded helmet may be attached to the football player's head using conventional straps associated with the shell system. The football helmet shell and the second inner pliable padded helmet typically comprise two separate pieces that fit together when the helmet is held on the wearer's head by straps or other attachment means connected to the helmet shell. In an alternative embodiment, the helmet shell and second inner pliable padded helmet are permanently attached to each other. Generally, the second inner pliable padded helmet is approximately ½" to 1" thick and the helmet shell is 1/16" to ¼" thick. The two integral layers of reinforcement are disposed on the inner and outer surfaces thereof.

The presence of reinforcing fibers on the shell's inner and outer surfaces prevents the helmet from bending excessively under impact. As a result, helmet impacts are sustained without undue shell bending, and the contact area between the inner surface of the helmet shell and the energy absorbing second inner pliable padded helmet is increased, resulting in efficient energy absorption. The increased contact area transfers the load of impact over a large area near the football player's head, reducing its overall intensity. By way of contrast, a typical polycarbonate helmet having similar bending resistance must be substantially thicker, and therefore much heavier, making the polycarbonate helmet much less comfortable to wear. In addition, when a polycarbonate helmet contacts another player, the extra weight produces a larger impact that is much more likely to injure that player's leg, knee or other body part. On the other hand, the helmet system's lightweight and shock absorbing characteristics protect the wearer, while minimizing risk of injury to other players. A reduced curvature of the helmet shell affords a larger area for contact between the second inner pliable padded helmet and the outer helmet shell. Loads are distributed over greater surface area, and the shock absorption area is increased. The presence of the second inner pliable padded helmet additionally decreases forces caused when the helmet contacts other players during blocking or tackling events. This force reduction results directly from the low force—deformation characteristic of the pliable material of the second inner helmet. It reduces significantly the injury suffered by other football players during game play. Fibers embedded on the outer and inner surfaces of the helmet shell provide superior resistance to breakdown by chemicals used to clean and disinfect the helmet, significantly improving in-service life and reliability. When compared to conventional helmet structures, the helmet system of this invention is stronger, lighter; safer; more reliable in use over extended time periods; and affords increased protection to players of impact sports.

The composite helmet system of the invention can be fabricated by several methods. During injection molding of the polycarbonate or other polymeric helmet, the mesh or net is placed on both faces of the helmet molding cavity and the polymer is melt injected into the cavity to form the composite helmet shell. The mesh or net of reinforcing long length fibers is permanently bonded to the polymeric helmet shell, producing a bend resistant helmet shell. An alternate method for producing the helmet includes layering the mesh or net on a previously molded helmet; burying the mesh or net in a polymeric solution that is compatible with the helmet shell material; and evaporating the solution to form a hardened polymer. A thermoset resin may also be used to bury the mesh or net of long length fiber mesh or net on the inner and outer surfaces of the helmet shell.

Impacts of the type occasioned by blocking or tackling events result in bending of the helmet shell. The interior of the molded helmet shell surface is placed under tension in all directions, while the exterior surface of the helmet is placed under compression in all directions. Most polymers will initiate cracks on the tension side, especially when subjected to biaxial tension. Cracks generated during biaxial tension eventually produce permanent indentations in the helmet shell, or cause the helmet shell to fracture. Increasing the thickness of a shell to combat this crack initiation problem merely reduces the over all magnitude of the stress at the impact point. Insufficient reduction in stress is accomplished, owing to stress singularity at the impact contact point, so that cracking is oftentimes not prevented. Significant penalties, including increased weight, discomfort, and heightened potential for injury to other players result directly from increased helmet shell thickness. On the other hand, the reinforced composite helmet shell system provides for increased shock absorption. Helmet shell cracking is virtually eliminated. The full lengths of fibers in the mesh or net are precisely aligned in the direction of tension and compression imposed on the helmet surface during impact. The shell design of the lightweight impact resistant football helmet system is markedly different from polymeric helmet shells produced by injection molding a blend of randomly oriented, short fibers. In such conventional helmets, the fibers are much too short to effectively transfer loading or stress from one fiber to the next. Moreover, with such conventional systems the fiber orientation is not aligned with the fiber length in the direction of stresses imposed by the impact. By way of comparison, the long-length fibers of the present helmet system are oriented with fiber length in the direction of impact imposing stresses. As a result, the helmet system of the invention is strong, light; safe; highly reliable in service over an extended period of time; and affords increased protection to the user as well as to other players of impact sports.

Figure 1B:
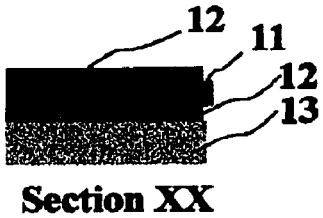
FIG. 1*b* is a section taken along the line X—X of FIG. 1*a*.

Referring to FIGS. 1A–1B there is shown generally at 10 a schematic arrangement of the lightweight impact resistant football helmet system. Depicted by FIG. 1A is a front view and by FIG. 1B a cross section taken along the line XX. The arrows in the front view indicate the direction of view. The molded shell of the helmet is shown at 11. A mesh or net of reinforcing high strength fibers composed of Kevlar® or Spectra® is shown at 12. Such high-strength fiber mesh or net is disposed on each of the inner and outer surfaces of the shell. The thickness of the helmet shell 11 is typically smaller than a conventional helmet, due to the strengthening properties afforded by reinforcing fibers placed and bonded permanently on the helmet's exterior and interior surfaces. Within the reinforced helmet 11 there is provided a second inner pliable padded helmet 13, which is in close contact with the wearer's head and the inner surface of the helmet shell 11. The helmet is secured to the wearer's head by an attachment means. In the embodiment depicted by FIG. 1A the attachment means comprises a strap 20 of conventional design (shown in broken view). During impact, the helmet shell 11 undergoes bending deformation. Bending is not severe; but rather exhibits a moderate to low curvature, causing shell 11 to contact a relatively large area of the inner pliable padded helmet 13. Loads resulting from impacts against the top and sides of shell 11 are distributed, reducing stresses and providing increased shock absorption. In addition, the lighter weight of the fiber reinforced helmet shell 11 limits the amount of applied force delivered by the helmet wearer against other football players during blocking or tackling events.

Advantageously, the helmet is exceedingly lightweight and easy to wear, thereby increasing protection from impact injuries. The increased protection results from 1) the high stiffness and bend resistance of the helmet shell; and 2) the shock absorption characteristics of the second inner pliable padded helmet. Player injuries resulting from high contact events are minimized. The mesh or net of long-length, high-strength fibers and the unique fiber orientation, endow the helmet shell with improved bend resistance, while the lighter weight of the helmet system promotes maneuverability and decreases forces applied against players during blocking and tackling events.

Having thus described the invention in rather full detail, it will be understood that such detail need not be strictly adhered to, but that additional changes and modifications may suggest themselves to one skilled in the art, all falling within the scope of the invention as defined by the subjoined claims.

What is claimed is:

1. A helmet system for a player engaged in contact sports, comprising:

a. a helmet shell having inner and outer surfaces reinforced with a bonded net or mesh of long length fibers comprising long-length para-aramid or high density polyethylene reinforcing fibers, said helmet shell being composed of a polymeric material selected from the group consisting of poly-alpha-olefins, homopolymers of ethylene, copolymers of ethylene and other alpha-olefins, polyamides, polycarbonate, polyvinyl chloride, cellulose acetobutyrate, polybutylene terephthalate, polyoxymethylene polymers, polyester, and epoxy;

b. a pliable, padded inner helmet attached to said inner surface of said helmet shell, said inner helmet being composed of shock absorbing material; and c. an attachment means disposed within said helmet shell for positioning and holding said second pliable padded inner helmet in contact with the player's head, said helmet shell producing a low curvature bend under impact load, increasing contact area between said inner surface and said inner helmet to thereby increase load absorption and decrease load intensity at the player's head.

2. A helmet system as recited by claim 1, wherein said helmet shell has a thickness ranging from about 1/16 to 1/4 inch.

3. A helmet system as recited by claim 1, wherein said polymeric material is polycarbonate.

4. A helmet system as recited by claim 1, wherein a full length of said fibers is said mesh or net is aligned in the direction of tension and compression imposed on said surfaces of said helmet during impact.

5. A helmet system as recited by claim 1, wherein said net or mesh has a length greater than 1 inch.

6. A helmet system as recited by claim 1, wherein said inner helmet is composed of energy absorbing polymeric foam.

7. A helmet system as recited by claim 1, wherein said inner helmet has a thickness ranging from about 0.5 to 1 inch.

8. A helmet system as recited by claim 1, wherein said attachment means comprises a strap.

9. In a helmet system having a helmet shell fabricated by injection molding a polymeric material into a molding cavity, the improvement wherein said polymeric material is at least one material selected from the group consisting of poly-alpha-olefins, homopolymers of ethylene, copolymers of ethylene and other alpha-olefins, polyamides, polycarbonate, polyvinyl chloride, cellulose acetobutyrate, polybutylene terephthalate, polyoxymethylene polymers, polyester, and epoxy; and a mesh or net of long length fibers comprising long-length para-aramid or high density polyethylene reinforcing fibers is disposed on both faces of the helmet molding cavity and integrally bonded with said polymeric material during molding to form a composite helmet shell.

* * * * *